US008277114B2

(12) United States Patent
Higbee et al.

(10) Patent No.: US 8,277,114 B2
(45) Date of Patent: Oct. 2, 2012

(54) GAS FOIL IMPELLER

(75) Inventors: Robert W. Higbee, Harrisburg, PA (US); Wojciech R. Wyczalkowski, Harrisburg, PA (US); Todd Hutchinson, Palmyra, PA (US)

(73) Assignee: Philadelphia Mixing Solutions, Ltd., Palmyra, PA (US)

( * ) Notice: Subject to any disclaimer, the term of this patent is extended or adjusted under 35 U.S.C. 154(b) by 718 days.

(21) Appl. No.: 12/339,875

(22) Filed: Dec. 19, 2008

(65) Prior Publication Data

US 2009/0231952 A1 Sep. 17, 2009

Related U.S. Application Data

(60) Provisional application No. 61/016,246, filed on Dec. 21, 2007.

(51) Int. Cl.
*B01F 7/22* (2006.01)

(52) U.S. Cl. ..... 366/270; 366/330.1; 366/330.3; 366/331; 416/231 A

(58) Field of Classification Search ..... 366/270, 366/330.1–330.3, 331; 416/231 A–231 B
See application file for complete search history.

(56) References Cited

U.S. PATENT DOCUMENTS

| | | | | |
|---|---|---|---|---|
| 3,648,989 | A * | 3/1972 | Friehe | 261/91 |
| 4,779,990 | A | 10/1988 | Hjort et al. | |
| 5,198,156 | A | 3/1993 | Middleton et al. | |
| 5,246,289 | A | 9/1993 | Middleton et al. | |
| 5,316,443 | A * | 5/1994 | Smith | 416/197 R |
| 5,791,780 | A | 8/1998 | Bakker | |
| 5,904,423 | A | 5/1999 | Forschner et al. | |
| 5,988,604 | A * | 11/1999 | McWhirter | 261/91 |
| 6,190,033 | B1 | 2/2001 | Rickman et al. | |
| 6,984,753 | B2 | 1/2006 | Gnagnetti et al. | |
| 7,114,844 | B2 * | 10/2006 | Weetman | 366/328.3 |
| 7,201,884 | B2 | 4/2007 | Cohen | |
| 7,296,925 | B2 * | 11/2007 | Himmelsbach et al. | 366/330.3 |
| 2006/0135815 | A1 | 6/2006 | Oguri et al. | |

OTHER PUBLICATIONS

Bakker, A., "A New Gas Dispersion Impeller with Vertically Asymmetric Blades," published in "The Online CFM Book" at URL < http://www.bakker.org/cfm>, 2000, 28 pages.

Myers, K.J. et al., "Performance of a Gas Dispersion Impeller with Vertically Asymmetric Blades," Trans IchemE, Nov. 1999, vol. 77, Part A, pp. 728-730.

* cited by examiner

*Primary Examiner* — Yogendra Gupta
*Assistant Examiner* — Emmanuel S Luk
(74) *Attorney, Agent, or Firm* — Woodcock Washburn LLP

(57) ABSTRACT

An impeller assembly includes a shaft, multiple scoops spaced circumferentially about the shaft, each scoop including an upper blade portion and a lower blade portion, spaced apart at the leading edges and joined at the inner edges, and a rib extending rearward from the inner edges, each scoop being coupled to the shaft by attachment at the rib. A system and method for mixing gas or liquid into liquid include a vessel for containing liquid, a drive shaft for extending into the vessel, and an impeller assembly adapted for rotating about the drive shaft, adapted for submerging below the liquid surface, and having multiple scoops, each scoop including an upper blade portion and a lower blade portion, spaced apart at the leading edges and joined at the inner edges, and a rib extending rearward from the inner edges, each scoop being coupled to the shaft by attachment at the rib.

43 Claims, 5 Drawing Sheets

GAS FOIL IMPELLER

CROSS-REFERENCE TO RELATED APPLICATIONS

This application claims priority to provisional U.S. patent application Ser. No. 61/016,246, filed Dec. 21, 2007, the contents of which are incorporated herein by reference in their entirety.

FIELD OF THE INVENTION

The present invention relates to a method and apparatus for mixing liquids and gasses, particularly a method and apparatus and impeller assembly for mixing a gas or a liquid into a liquid.

BACKGROUND OF THE INVENTION

Mixing vessels may be used in a variety of industrial applications. They may be used as precipitators in alumina production, anaerobic digesters in waste water treatment, and in many other applications.

Impellers are frequently used to mix gas into a liquid in situations where high efficiency and high power are needed. Typical industrial applications for such impellers include plastic and production of terephthalic acid, fermentation, production of antibiotics, and hydrogenation.

It is generally desirable for an impeller assembly that is used for dispersing gasses or liquids into liquids to have certain characteristics. Some advantageous characteristics include (1) a low power number (i.e., an impeller power constant that is related to the specific geometry of the impeller, which is related to the ratio of the mechanical drive power draw to the radial pumping energy transmitted to the fluid), (2) high gas disbursement capacity without flooding (i.e., when the impeller blades are inundated by a high amount of gas, such that liquid pumping is substantially diminished), (3) flat power characteristics (consistency of power draw) regardless of the rate of gas injection or disbursement into the mixing vessel (i.e., an impeller may lose power while mixing gas into a liquid), and (4) the capability to suspend solid particles in the liquid in the vessel during gas injection.

The impeller according to the present invention encompasses is generally directed to such characteristics, but the present invention is not limited to possessing all of these characteristics.

SUMMARY OF THE INVENTION

An impeller assembly includes a shaft and plural scoops spaced circumferentially about the shaft. Each scoop includes an upper blade portion, a lower blade portion, and a rib. The upper blade portion and the lower blade portion have leading edges, inner edges, and peripheral edges. The upper blade portion and the lower blade portion are joined at the inner edges. The upper blade portion and the lower blade portion are spaced apart at the leading edges. The rib extends rearward from the inner edges, the scoop being coupled to the shaft by attachment at the rib.

The impeller assembly may also include a central plate, coupled to each of the plural scoops by its horizontal rib, and the central plate may also have symmetric, crenellated spars. The impeller assembly may also include inner edges of each of the plural scoops that define a straight line, and the rib of each of the plural scoops may be in a plane perpendicular to the axis of rotation. The impeller assembly may also include each of the at least one scoop having a rearward rake angle, and the rearward rake angle at a radius of one-third of the diameter of the impeller assembly may be approximately fifteen degrees. The impeller assembly may also include peripheral edges of the upper blade portion and the lower blade portion that have a rounded profile.

A system for mixing gas or liquid into liquid is also disclosed, including a vessel for containing liquid, a drive shaft for extending into the vessel, and an impeller assembly, the impeller assembly being adapted for rotating about a long axis of the drive shaft, adapted for submerging below the liquid surface, and having plural scoops, the scoops including an upper blade portion and a lower blade portion, the upper blade portion and the lower blade portion having leading edges, inner edges, and peripheral edges, the upper blade portion and the lower blade portion joined at the inner edges, the upper blade portion and the lower blade portion spaced apart at the leading edges, and a rib extending rearward from the inner edges, the scoop being coupled to the shaft by attachment at the rib.

The system for mixing gas or liquid into liquid may also include a vertical drive shaft. The impeller assembly included in the system for mixing gas or liquid into liquid may also include a central plate, coupled to each of the plural scoops by its horizontal rib, and the central plate may also have symmetric, crenellated spars. The impeller assembly included in the system for mixing gas or liquid into liquid may also include inner edges of each of the plural scoops that define a straight line, and the rib of each of the plural scoops may be in a plane perpendicular to the axis of rotation. The impeller assembly included in the system for mixing gas or liquid into liquid may also include each of the at least one scoop having a rearward rake angle, and the rearward rake angle at a radius of one-third of the diameter of the impeller assembly may be approximately fifteen degrees. The impeller assembly included in the system for mixing gas or liquid into liquid may also include peripheral edges of the upper blade portion and the lower blade portion that have a rounded profile.

A method of mixing gas or liquid into liquid includes: providing a vessel for containing liquid, and providing an impeller assembly for rotating about a long axis of the drive shaft and submerging below the liquid surface. The impeller assembly has plural scoops that includes an upper blade portion, a lower blade portion, and a rib. The upper blade portion and the lower blade portion have leading edges, inner edges, and peripheral edges. The upper blade portion and the lower blade portion are joined at the inner edges and are spaced apart at the leading edges. The rib extends rearward from the inner edges. The scoop is coupled to the shaft by attachment at the rib.

The method of mixing gas or liquid into liquid may also include providing a vertical drive shaft. The impeller assembly provided in the method of mixing gas or liquid into liquid may also include a central plate, coupled to each of the plural scoops by its horizontal rib, and the central plate may also have symmetric, crenellated spars. The impeller assembly provided in the method of mixing gas or liquid into liquid may also include inner edges of each of the plural scoops that define a straight line, and the rib of each of the plural scoops may be in a plane perpendicular to the axis of rotation. The impeller assembly provided in the method of mixing gas or liquid into liquid may also include each of the at least one scoop having a rearward rake angle, and the rearward rake angle at a radius of one-third of the diameter of the impeller assembly may be approximately fifteen degrees. The impeller assembly provided in the method of mixing gas or liquid into liquid may also include peripheral edges of the upper blade portion and the lower blade portion that have a rounded profile.

The drawbacks of the prior art and advantages of particular embodiments are provided for context, and the present invention is not limited to the problems or solutions explained or implicitly provided herein. Aspects of the invention are illustrated in the embodiments shown herein, and the present invention is not limited to the particular embodiments, but rather is intended to be broadly interpreted according to the full breadth of the claims.

DETAILED DESCRIPTION OF ILLUSTRATIVE EMBODIMENTS

Figure 1:
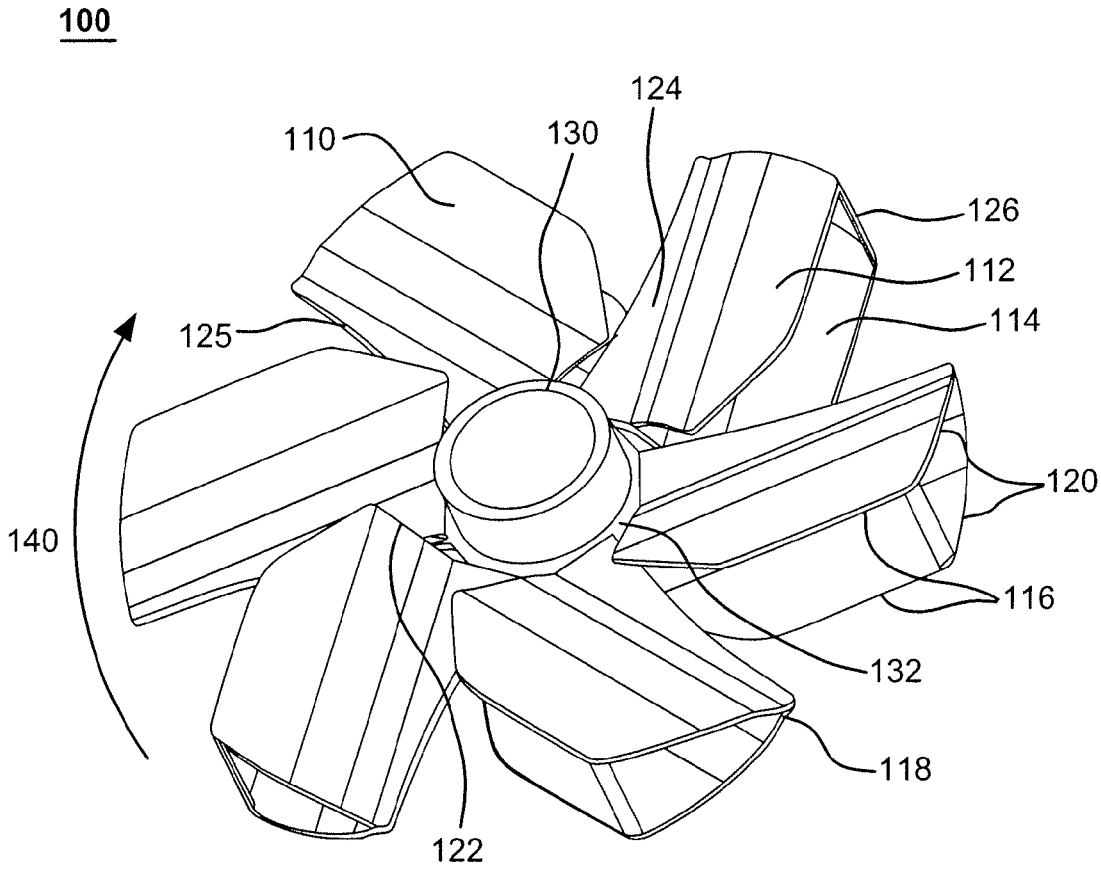
FIG. 1 is a perspective view of an impeller assembly according to an aspect of the present invention.

Referring to FIG. 1, an impeller assembly 100 includes plural blade assemblies 110, a central hub 130, and attachment plate 132. Each blade assembly 110 includes an upper blade portion 112, a lower blade portion 114, leading edges 116, inner edges 118, peripheral edges 120, inner peripheral edges 122, a rib 124, a trailing edge 125, and an outer spar 126.

Each blade assembly 110 is coupled to a drive shaft 210 (FIG. 2B), through central hub 130 and attachment plate 132. Blade assemblies 110 preferably are equidistantly spaced about the circumference of the impeller. Each scoop is formed by upper blade portion 112 and lower blade portion 114. In a preferred embodiment shown in FIG. 1, upper blade portion 112 and lower blade portion 114 are flat, sheet-like, segmented sections that are mirror images of each other (when viewed from the side as in FIG. 3A). Alternatively, upper blade portion 112 and lower blade portion 114 may have different shapes (i.e., not mirror images of each other) (not shown in the Figures), depending on the desired parameters of the gas or liquid mixing process. Each scoop has a concave shape, open at the leading edges 116 and closed at the inner edges 118 of upper blade portion 112 and lower blade portion 114. Impeller assembly 100 is rotated in rotational direction 140 (shown as clockwise in FIG. 1). Rotational direction 140 is such that the open side (at leading edges 116) of each blade assembly 110 is directed into the liquid 420.

In the embodiment shown in FIG. 1, peripheral edges 120 have a round profile, such that (preferably) each peripheral edge defines an arcuate segment of a single, discontinuous circle. This round profile of peripheral edges 120 may also be seen in FIG. 2A and in FIG. 3B as the arc A1D1. In other embodiments, peripheral edges 120 may be other shapes, including a curve resembling an air foil, or a straight line (not shown in the Figures). The inventors theorize that having a rounded profile of peripheral edges 120 produces a lower drag effect (compared to a straight line profile) as impeller assembly 100 moves through liquid 420.

Figure 2A:
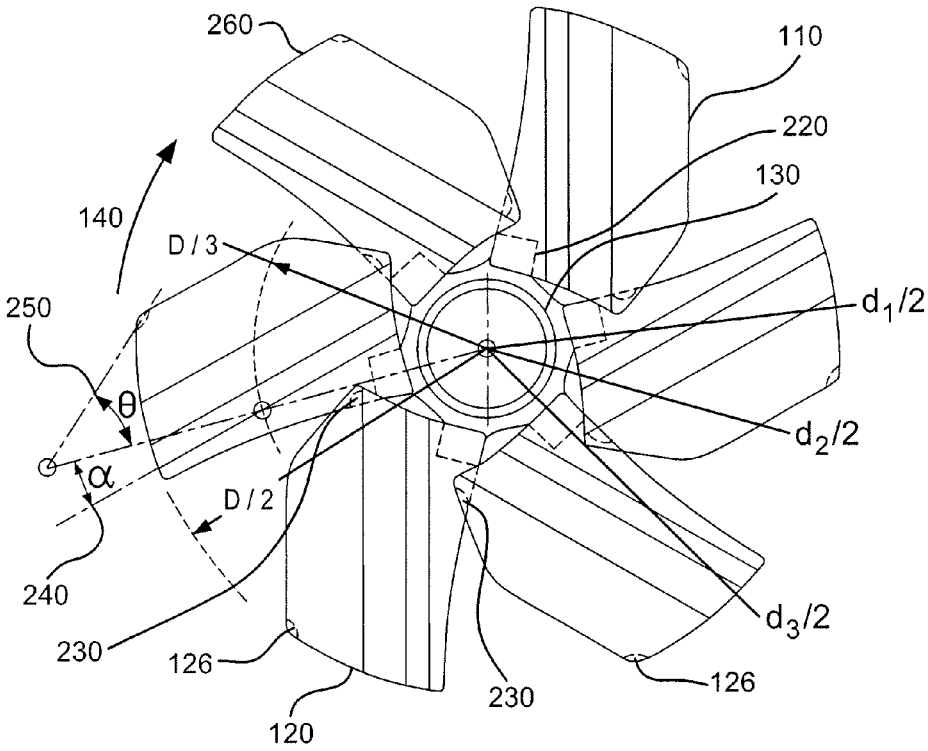
FIG. 2A is a top view of the impeller assembly.
Figure 3A:
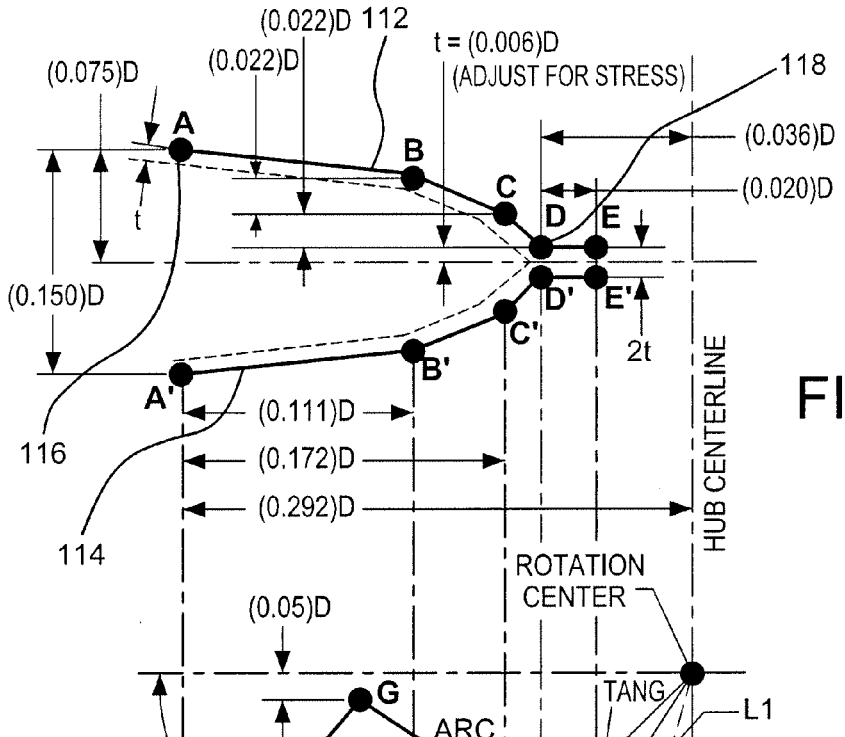
FIG. 3A is a side of a single impeller blade employed in the impeller assembly.
Figure 3B:
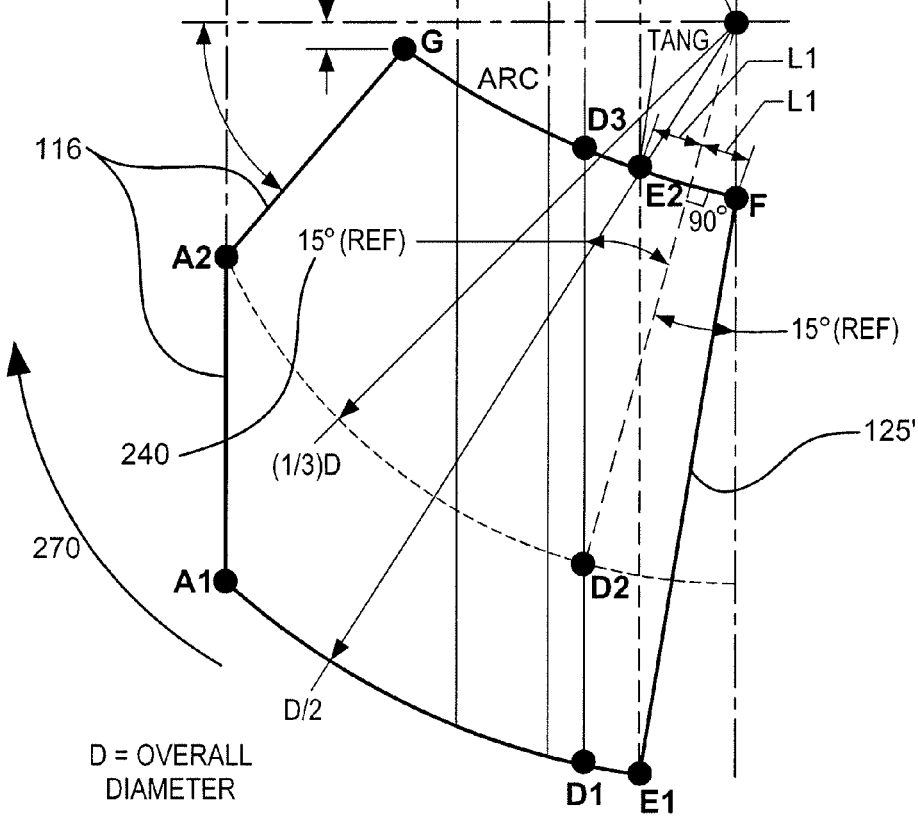
FIG. 3B is a top view of a single impeller blade employed in the impeller assembly.

Rib 124 extends rearward from the inner edges 118 of each blade assembly 110. As shown in FIGS. 1 and 2A, trailing edge 125 defined by rib 124 has a smooth curve such that rib 124 is wider at its base than at its periphery. FIG. 3B shows an alternative shape of the rib at trailing edge 125 that defines a straight line (line F-E1, described more fully below), which is indicated by reference numeral 125'. As shown in FIGS. 3A and 3B, rib 124 is bounded by the points D1, D3, F, and E1, forming a trapezoid shape. This design, including rib 124 being wider at its base) may increase the strength of rib 124 at the point where blade assembly 110 is coupled to drive shaft 210. The figures show hub and attachment plate 132 coupled between shaft 210 and blade assemblies 110, and the present invention encompasses any attachment configuration unless specifically recited in the claims.

In a preferred embodiment, rib 124 serves as a structural support, which stiffens blade assembly 110. Rib 124 also serves as an attachment surface to allow blade assembly 110 to be coupled to drive shaft 210. The inventors theorize that the flat profile of rib 124, extending rearward from inner edges 118 of blade assembly 110, produces a lower drag effect (compared to blades without a rib 124) as impeller assembly 100 moves through fluid 420.

Figure 4A:
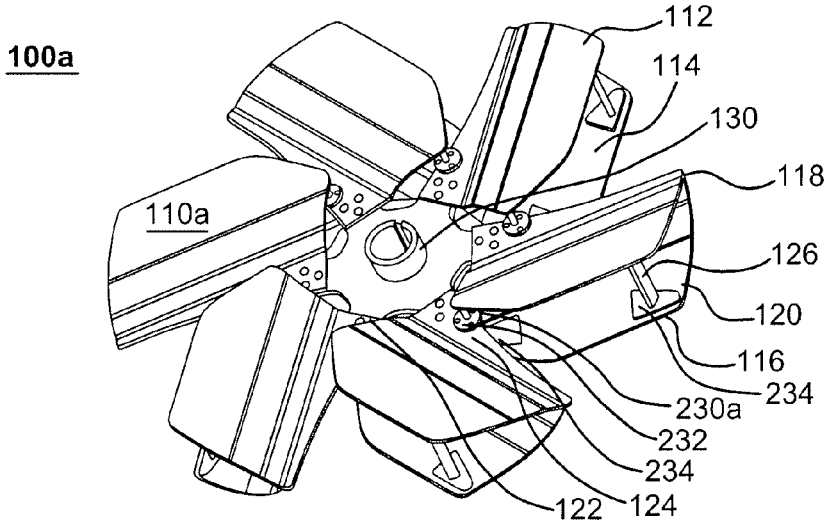
FIG. 4A is a perspective view of an impeller assembly according to another aspect of the present invention.
Figure 4B:
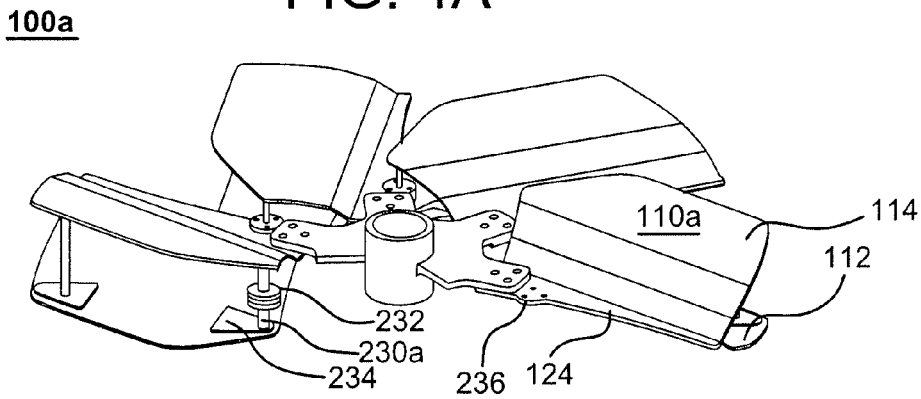
FIG. 4B is a perspective view of a portion of the impeller assembly depicted in FIG. 4A.

Outer spar 126 preferably is structural such that it supports and holds blade portions 112 and 114 near edges 116 and 120. In some embodiments, as shown in FIGS. 4A and 4B, outer spar 126 may be affixed to blade portions 112 and 114 at locations that are offset from edges 116 and 120 by any distance. For example, in FIGS. 4A and 4B, outer spar 126 is affixed to blade portions 112 and 114 at locations that are offset from leading edge 116 by approximately 10% of the length of peripheral edge 120, and outer spar 126 is affixed to blade portions 112 and 114 at locations that are offset from peripheral edge 120 by approximately 10% of the length of leading edge 116. As shown in FIGS. 4A and 4B, outer spar 126 preferably is mounted to blade portions 112 and 114 by affixing outer spar 126 to respective reinforcing pads 234 (which are shown, for example, as substantially triangular in shape). As shown, first and second reinforcing pads 234 are affixed to respective blade portions 112 and 114.

Reinforcing pads 234 may be any size relative to blade portions 112 and 114. Preferably, each reinforcing pad 234 is located on blade portions 112 and 114 near leading edge 116. Each reinforcing pad 234 preferably extends along blade portions 112 and 114 approximately 5-20% of the length of leading edge 116, substantially along an axis between peripheral edge 120 and inner peripheral edge 122. Each reinforcing pad 234 preferably extends along blade portions 112 and 114 approximately 5-20% of the length of peripheral edge 120, substantially along an axis between leading edge 116 and inner edge 118.

The inventors theorize that offsetting outer spar 126 from edges 116 and 120 and affixing outer spar 126 to blade portions 112 and 114 via reinforcing pads 234 help to equalize the bending stresses across blade portions 112 and 114 during rotation of impeller assembly 100*a*, thereby potentially reducing the maximum bending stress around the mounting locations of outer spar 126. Having a lower maximum bending stress in blade portions 112 and 114 may potentially allow blade portions 112 and 114 of impeller assembly 100*a* (shown, for example, in FIGS. 4A and 4B) to be thinner (e.g., made from thinner sheets of metal) for a given use of impeller assembly 100*a*, compared to an impeller assembly having outer spar 126 located closer to edges 116 and 120 and mounted without reinforcing pads 234 (shown, for example, in FIG. 1).

Inner spar 230, which is not shown in FIG. 1 to indicate that it is optional, preferably is structural such that it supports and holds blade portions 112 and 114 near the inner peripheral edge 122. The upper and lower portions of inner spar 230 are affixed to the rib 124 of adjacent (leading) scoop. The cross section of outer spar 126 preferably is substantially tear-drop shaped (e.g., rounded at the leading edge, thickest near the leading edge, and thinnest at the trailing edge), which tends to minimize the drag coefficient when impeller assembly 100 is rotated in rotational direction 140. The cross section of inner spar 230 preferably is oval-shaped, which tends to minimize the drag coefficient when impeller assembly 100 is rotated in rotational direction 140. The cross sections of outer spar 126 and inner spar 230 may also be other shapes, including round, oval, crescent-shaped, tear-drop-shaped, an airfoil-curved shape, or rectangular. The cross sections of outer spar 126 and inner spar 230 preferably are symmetrical about the longitudinal axis, but the cross sections may also be asymmetrical about the longitudinal axis.

The orientation of the cross-section of outer spar 126 (when it is not round) has an outer spar angle 250, also shown in FIG. 2A as angle θ, which preferably is chosen so that the cross-section of outer spar 126 points into the combined radial pumping vector (generally flowing out across peripheral edges 120) and incoming fluid flow vector (generally flowing in across leading edges 116) in order to further minimize the drag coefficient.

The profile of the leading edges 116 of one blade assembly 110 overlaps rib 124 of another blade assembly 110 at point G (point G is shown in FIG. 3B). This overlap allows inner spar 230 (approximately located at point G) of one blade assembly 110 to be mounted to rib 124 of another blade assembly 110. Inner spar 230 may be mounted in any of several different ways, including welding, passing inner spar 230 through a hole in rib 124, using screws, or using any other attachment mechanism known to those in the pertinent art. For example, as shown in FIG. 4B, the upper and lower portions of inner spar 230*a* are welded to respective cylindrical tabs 232 located where the upper and lower portions of inner spar 230*a* are closest to each other. Each cylindrical tab 232 is bolted to a mounting portion 236 of rib 124 of another blade assembly 110. The bolting of each cylindrical tab 232 to a mounting portion 236 of rib 124 of another blade assembly 10 preferably is performed during installation of the impeller assembly 100, 100*a*, or 100*b* in a user's facility. The upper and lower portions of inner spar 230*a* are welded to respective reinforcing pads 234 located where the upper and lower portions of inner spar 230*a* are farthest from each other. Respective reinforcing pads 234 are welded to upper blade portion 112 (affixed to the upper portion of inner spar 230*a* via a first reinforcing pad 234) and lower blade portion 114 (affixed to the lower portion of inner spar 230*a* via a second reinforcing pad 234).

Rearward rake angle 240 is the angle that the inner edges 118 (where the interior blade surface of upper blade portion 112 joins the interior blade surface of lower blade portion 114) make with the line beginning at the center of central hub 130 and crossing inner edges 118 at a point that is a distance from central hub 130 that is one-third of the diameter of impeller assembly 100 (D/3). This rearward rake angle 240 is shown in FIG. 2A as angle α.

Rearward rake angle 240 is also depicted in FIG. 3B. In FIG. 3B, inner edges 118 are defined by line segment D1D3. Trailing edge 125 is defined by line segment E1F. This rake angle is rearward because a projection of the D1D3 vector towards the inner peripheral edges 122 of a blade assembly 110 will fall on the leading fluid side of central hub 130, assuming a clockwise rotational direction 140 of blade assembly 110. This rearward rake angle 240 tends to deflect incoming fluid outwards, away from central hub 130, towards peripheral edges 120, in the same direction as liquid 420 is directed by the centrifugal forces generated by the clockwise rotation of impeller assembly 100.

The rearward rake angle 240 that D1D3 makes with respect to a line emanating from the axis of rotation and intersecting D1D3 at a radius equal to one-third of the diameter of impeller assembly 100 (D/3) is fifteen (15) degrees. In other embodiments, rearward rake angle 240 may be other values, ranging from one (1) degree to eighty-nine (89) degrees. This design may also be used with a zero rake angle (in which the flow of fluid 420 is directly radial, or with a forward rake angle (in which a projection of the D1D3 vector towards the inner peripheral edges 122 of a blade assembly 110 will fall on the trailing fluid side of central hub 130, assuming a clockwise rotational direction 140 of blade assembly 110).

The side view profile of each blade assembly 110 is concave in shape. As shown in FIG. 3A, the side view of leading edges 116 is represented by A and A', the side view of inner edges 118 is represented by D and D', and the side view of trailing edge 125 is represented by E and E'.

Again referring to FIG. 3A, upper blade portion 112 is a sheet-like segmented section, and it is constructed of a series of four flat planar segments, represented in the side view of FIG. 3A as the segments AB, BC, CD, and DE. Each of these planar segments are separated by discrete bends. Lower blade portion 114 is also a sheet-like segmented section, and it is approximately the mirror image of the upper section. In other embodiments, upper blade portion 112 and lower blade portion 114 may have different shapes (i.e., not approximately mirror images of each other). Lower blade portion 114 is constructed of a series of four flat planar segments, represented in the side view of FIG. 3A as the segments A'B', B'C', C'D', and D'E'. Both upper blade portion 112 and lower blade portion 114 can be formed from a single sheet of flat metal stock.

Alternatively, the side profile of upper blade portion 112 and lower blade portion 114 may be smoothly varying curved segments (not shown in the Figures), as opposed to flat planar segments.

The distance between upper blade portion 112 and lower blade portion 114 diminishes exponentially from the open side towards the closed side of blade assembly 110, gradually diminishing near leading edge 116 and more rapidly diminishing near inner edge 118. This exponentially-diminishing side profile shape may give blade assembly 110 a lower fluid drag coefficient and more consistent power draw over a wide range of gas injection rates, compared to other designs.

Although a particular set of side profile and top profile dimensions of blade assembly 110 are shown in the preferred embodiment represented in FIGS. 3A and 3B, these specific dimensional relationships may vary, and other side profiles of blade assembly 110 may be used.

Figure 4C:
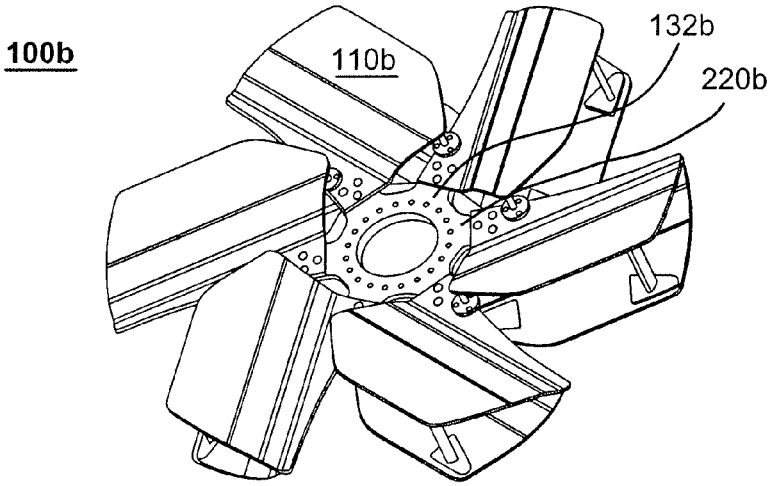
FIG. 4C is a perspective view of an impeller assembly according to yet another aspect of the present invention.

Attachment plate 132 includes crenellations 220 that are approximately rectangular in shape, although they may also be other shapes. Attachment plate 132 is attached to a central hub 130, and it provides an attachment surface for blade assemblies 110. Blade assemblies 110 may be bolted or welded to crenellations 220. In other embodiments, blade assemblies 110 may be attached directly to attachment plate 132 or directly to central hub 130. The presence of central hub 130 is optional. Any attachment mechanism may be used to affix blade assemblies 110 to drive shaft 210 (shown in FIG. 2B). In some embodiments, for example, as shown in FIG. 4C, blade assemblies 110*b* are affixed (using bolts or welding, for example) to crenellations 220*b* in attachment plate 132*b* without using a central hub. Instead, attachment plate 132*b* may be directly affixed (using bolts or welding, for example) to a flange (not shown) extending from drive shaft 210. The flange extending from drive shaft 210 preferably is substantially parallel to attachment plate 132*b*. Attachment plate 132*b* may be made from a single casting or formed piece of metal, for example, or attachment plate 132*b* may be made from two or more portions that may be bolted together during installation at a user's facility.

Figure 2B:
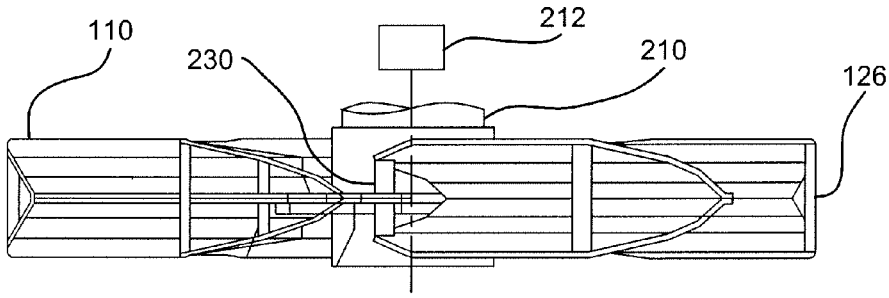
FIG. 2B is a side view of the impeller assembly.

As best shown in FIGS. 2A and 2B, an impeller assembly 100 is attached to a drive shaft 210, which is driven by a mechanical drive that is schematically as reference numeral 212. Impeller assembly 100 rotates in rotational direction 140.

Preferably, central hub 130, attachment plate 132, and crenellations 220 are a contiguous metal piece. This may allow for simplified fabrication and an uninterrupted circular interface between central hub 130 and drive shaft 210. Attachment plate 132 may prevent gas near central hub 130 from passing between the inner peripheral edges 122 of blade assemblies 110 and central hub 130. In a preferred embodiment, the diameter of attachment plate 132 is approximately twenty percent (20%) of the diameter of impeller assembly 100. The diameter of attachment plate 132 may range from approximately the diameter of central hub 130 to approximately the diameter of impeller assembly 100. In other embodiments, attachment plate 132 may only serve to provide added stiffness to crenellations 220, so the diameter of attachment plate 132 may be approximately equal to the diameter of central hub 130. The diameter of attachment plate 132 may vary relative to the total diameter of impeller assembly 100, depending on the diameter of central hub 130, the stiffness requirements of crenellations 220, and the length of blade assemblies 110. This design, where desired, allows the inner peripheral edges 122 of blade assemblies 110 to be very close to central hub 130, relative to the total diameter of impeller assembly 100, which allows for a larger pumping surface area than in previous impeller designs in some circumstances.

Central hub 130 may be welded to drive shaft 210, or it may incorporate a keyway or set screw to prevent rotation of central hub 130 relative to drive shaft 210. Alternatively, central hub 130 incorporates a welded or casted attachment plate 132 and crenellations 220 for coupling of blade assemblies 110 to central hub 130. In other embodiments, blade assemblies 110 are welded to attachment plate 132 or bolted to the attachment plate 132 casting. The lower end of drive shaft 210 may protrude below blade assemblies 110, reaching a lower depth in liquid 420 than the blades.

Mechanical drive 212 may be any constant speed or variable speed drive known in the pertinent art that may be adapted to rotate drive shaft 210 and blade assemblies 110 to the desired speed. Mechanical drive 212 is coupled to the upper end of drive shaft 210. In operation, the torque transmitted by mechanical drive 212 to drive shaft 210 is transmitted from the shaft to a central hub 130.

Figure 5:
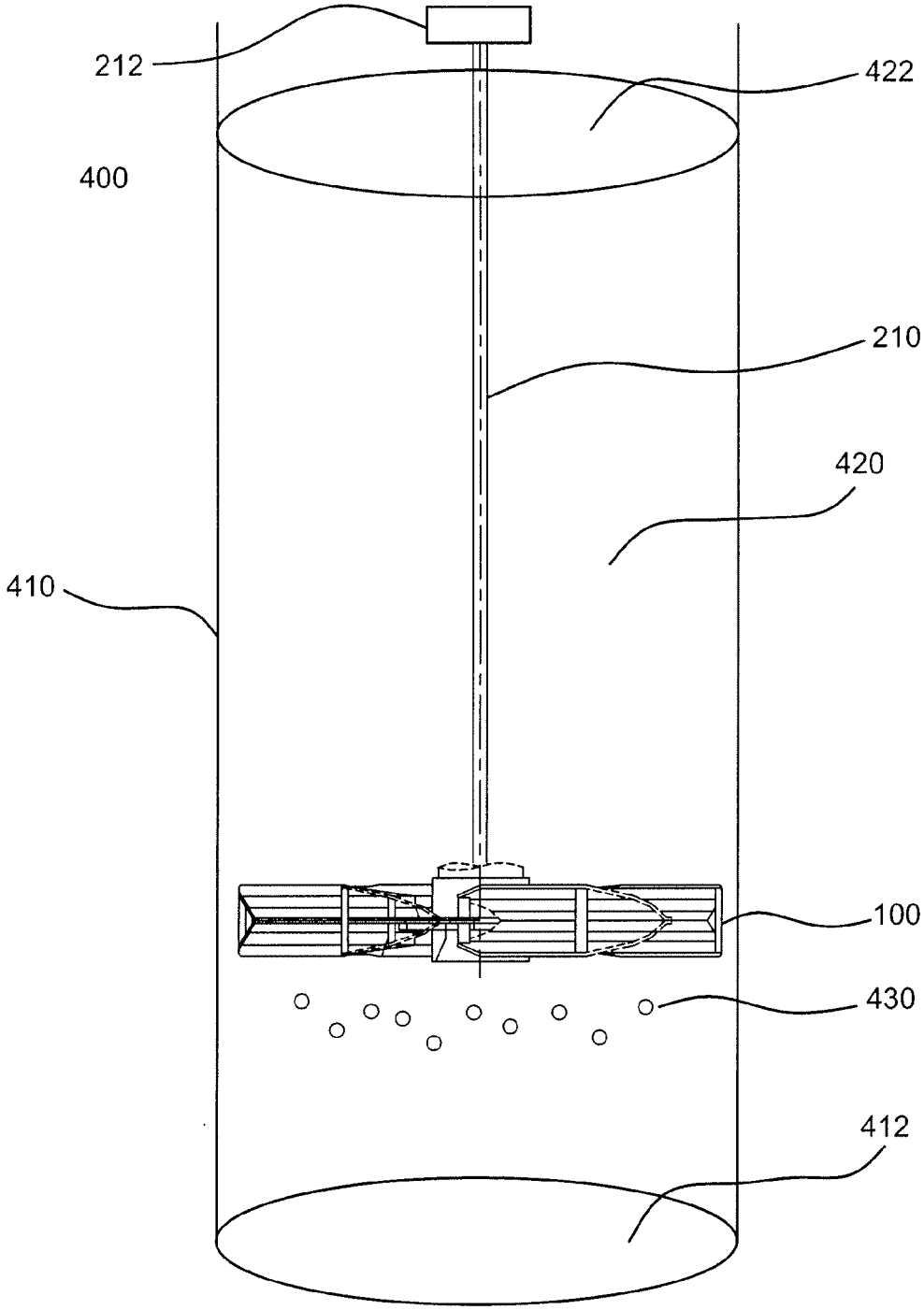
FIG. 5 is a side view of a system employing an impeller assembly according to the invention.

FIG. 5 is a side view of a system 400 for mixing a gas 430 into a liquid 420. System 400 includes a vessel assembly 410 having a vessel bottom 412 and an impeller assembly 100 as described above. Liquid 420 defines a liquid surface 422.

It is desired that gas 430 be disbursed into fluid 420. Impeller assembly 100 rotates within fluid 420 in order to enhance the dispersion of gas 430, which is injected into the vessel 410 (preferably) by conventional means, such as by a sparge ring or other means. Impeller assembly 100 agitates fluid 420 in order to accomplish disbursement of gas 430, and impeller assembly 100 may function to suspend solid particulate (which may or may not be present) within fluid 420. System 400 also may be employed to disperse a first liquid into a second liquid (not indicated in the figures).

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

What is claimed is:

1. An impeller assembly, comprising:

a shaft;

plural scoops spaced circumferentially about the shaft, each scoop including:

an upper blade portion and a lower blade portion, said upper blade portion and said lower blade portion having leading edges, inner edges, and peripheral edges, said upper blade portion and said lower blade portion joined at the inner edges, said upper blade portion and said lower blade portion spaced apart at the leading edges; and a rib that is at least proximate to the peripheral edges and extends rearward from the inner edges, said scoop being coupled to the shaft by attachment at the rib.

2. The impeller assembly of claim 1, wherein said impeller assembly further comprises a central plate, coupled to each of the plural scoops by its rib.

3. The impeller assembly of claim 2, wherein the central plate has symmetric, crenellated spars.

4. The impeller assembly of claim 1, wherein the inner edges of each of the plural scoops define a straight line, and the rib of each of the plural scoops is in a plane perpendicular to the axis of rotation.

5. The impeller assembly of claim 1, wherein each of said at least one scoop has a rearward rake angle.

6. The impeller assembly of claim 5, wherein the rearward rake angle at a radius of one-third of the diameter of the impeller assembly is approximately fifteen degrees.

7. The impeller assembly of claim 1, wherein said peripheral edges of said upper blade portion and said lower blade portion have a rounded profile.

8. A system for mixing gas or liquid into liquid, the system comprising:

a vessel for containing liquid;

a drive shaft that extends into the vessel;

an impeller assembly, said impeller assembly:

adapted for rotating about a long axis of the drive shaft;

adapted for submerging below the liquid surface;

having plural scoops, said scoops including:

an upper blade portion and a lower blade portion, said upper blade portion and said lower blade portion having leading edges, inner edges, and peripheral edges, said upper blade portion and said lower blade portion joined at the inner edges, said upper blade portion and said lower blade portion spaced apart at the leading edges; and a rib that is at least proximate to the peripheral edges and extends rearward from the inner edges, said scoop being coupled to the shaft by attachment at the rib.

9. The system of claim 8, wherein said drive shaft is vertical.

10. The system of claim 8, wherein said impeller assembly further comprises a central plate, coupled to each of the at least one scoops by its rib.

11. The system of claim 10, wherein the central plate has symmetric, crenellated spars.

12. The system of claim 8, wherein the inner edges of each of the plural scoops define a straight line, and the rib of each of the plural scoops is in a plane perpendicular to the axis of rotation.

13. The system of claim 8, wherein each of said at least one scoop has a rearward rake angle.

14. The system of claim 13, wherein the rearward rake angle at a radius of one-third of the diameter of the impeller assembly is approximately fifteen degrees.

15. The system of claim 8, wherein said peripheral edges of said upper blade portion and said lower blade portion have a rounded profile.

16. A method of mixing gas or liquid into liquid, comprising the steps of:

providing a vessel for containing liquid;

providing an impeller assembly, said impeller assembly:

adapted for rotating about a long axis of the drive shaft;

adapted for submerging below the liquid surface;

having plural scoops, said scoops including:

an upper blade portion and a lower blade portion, said upper blade portion and said lower blade portion having leading edges, inner edges, and peripheral edges, said upper blade portion and said lower blade portion joined at the inner edges, said upper blade portion and said lower blade portion spaced apart at the leading edges; and a rib that is at least proximate to the peripheral edges and extends rearward from the inner edges, said scoop being coupled to the shaft by attachment at the rib.

17. The method of claim 16, wherein said drive shaft is vertical.

18. The method of claim 16, wherein said impeller assembly further comprises a central plate, coupled to each of the at least one scoops by its rib.

19. The method of claim 18, wherein the central plate has symmetric, crenellated spars.

20. The method of claim 16, wherein the inner edges of each of the plural scoops define a straight line, and the rib of each of the plural scoops is in a plane perpendicular to the axis of rotation.

21. The method of claim 16, wherein each of said at least one scoop has a rearward rake angle.

22. The method of claim 21, wherein the rearward rake angle at a radius of one-third of the diameter of the impeller assembly is approximately fifteen degrees.

23. The method of claim 16, wherein said peripheral edges of said upper blade portion and said lower blade portion have a rounded profile.

24. The impeller assembly of claim 1 wherein the rib is continuous from the attachment of the rib at the central plate to the periphery.

25. The impeller assembly of claim 1 wherein upper blade portion and lower blade portion are formed of planar sections joined at discrete bends.

26. An impeller assembly, comprising:

a shaft;

rearwardly raked plural scoops spaced circumferentially about the shaft, each scoop including:

an upper blade portion and a lower blade portion, said upper blade portion and said lower blade portion having leading edges, inner edges, and peripheral edges, said upper blade portion and said lower blade portion joined at the inner edges, said upper blade portion and said lower blade portion spaced apart at the leading edges; and a rib extending rearward from the inner edges, said scoop being coupled to the shaft by attachment at the rib.

27. The impeller assembly of claim 26, wherein said impeller assembly further comprises a central plate, coupled to each of the at least one scoops by its rib.

28. The impeller assembly of claim 27, wherein the central plate has symmetric, crenellated spars.

29. The impeller assembly of claim 26, wherein the inner edges of each of the plural scoops define a straight line, and the rib of each of the plural scoops is in a plane perpendicular to the axis of rotation.

30. The impeller assembly of claim 26, wherein said peripheral edges of said upper blade portion and said lower blade portion have a rounded profile.

31. An impeller assembly, comprising:

a shaft;

plural scoops spaced circumferentially about the shaft, each scoop including:

an upper blade portion and a lower blade portion, said upper blade portion and said lower blade portion having leading edges, inner edges, and peripheral edges, said upper blade portion and said lower blade portion joined at the inner edges, said upper blade portion and said lower blade portion spaced apart at the leading edges, said peripheral edges being curved; and a rib extending rearward from the inner edges, said scoop being coupled to the shaft by attachment at the rib.

32. The impeller assembly of claim 31, wherein said impeller assembly further comprises a central plate, coupled to each of the at least one scoops by its rib.

33. The impeller assembly of claim 32, wherein the central plate has symmetric, crenellated spars.

34. The impeller assembly of claim 31, wherein the inner edges of each of the plural scoops define a straight line, and the rib of each of the plural scoops is in a plane perpendicular to the axis of rotation.

35. The impeller assembly of claim 31, wherein each of said at least one scoop has a rearward rake angle.

36. The impeller assembly of claim 31, said peripheral edges of said upper blade portion and said lower blade portion have a rounded profile.

37. The impeller assembly of claim 31, wherein the peripheral edges define a circular arc profile centered on the shaft axis of rotation.

38. An impeller assembly, comprising:

a shaft;

plural scoops spaced circumferentially about the shaft, each scoop including:

an upper blade portion and a lower blade portion, said upper blade portion and said lower blade portion having leading edges, inner edges, and peripheral edges, said upper blade portion and said lower blade portion joined at the inner edges, said upper blade portion and said lower blade portion spaced apart at the leading edges; and a rib extending rearward from the inner edges, said scoop being coupled to the shaft by attachment at the rib; and an attachment plate that is circumferentially continuous about the shaft, the attachment plate having a diameter no more than approximately 20 percent of the diameter of the impeller defined by the peripheral edges.

39. The impeller assembly of claim 38, wherein said impeller assembly further comprises a central plate, coupled to each of the at least one scoops by its rib.

40. The impeller assembly of claim 39, wherein the central plate has symmetric, crenellated spars.

41. The impeller assembly of claim 38, wherein the inner edges of each of the plural scoops define a straight line, and the rib of each of the plural scoops is in a plane perpendicular to the axis of rotation.

42. The impeller assembly of claim 38, wherein each of said at least one scoop has a rearward rake angle.

43. The impeller assembly of claim 38, wherein said peripheral edges of said upper blade portion and said lower blade portion have a rounded profile.

* * * * *